United States Patent [19]

Irino et al.

[11] Patent Number: 4,961,355

[45] Date of Patent: Oct. 9, 1990

[54] THROTTLE CONTROL SYSTEM

[75] Inventors: Hiroshi Irino; Mitsumasa Iida, both of Wako, Japan

[73] Assignee: Honda Giken Kogyo Kabushiki Kaisha, Tokyo, Japan

[21] Appl. No.: 378,690

[22] Filed: Jul. 12, 1989

[30] Foreign Application Priority Data

Jul. 14, 1988 [JP] Japan ..... 63-175347

[51] Int. Cl.[5] ..... G05G 1/14; F02B 77/00

[52] U.S. Cl. ..... 74/513; 123/138 D; 123/138 DB; 261/65

[58] Field of Search ..... 74/513, 512, 516, 500.5, 74/501.5 R; 261/65; 251/229, 251; 123/198 D, 198 DB

[56] References Cited

U.S. PATENT DOCUMENTS

| | | | |
|---|---|---|---|
| 3,698,372 | 10/1972 | Eshelman et al. | 123/198 DB |
| 3,927,657 | 12/1975 | Mennesson | 74/513 X |
| 4,002,085 | 1/1977 | Johnston | 74/513 |
| 4,320,673 | 3/1982 | Wegert | 74/501.5 R |
| 4,476,068 | 10/1984 | Griffin et al. | 74/516 X |
| 4,480,367 | 11/1984 | Johnson et al. | 261/65 X |
| 4,526,060 | 7/1985 | Watanabe | 74/513 X |
| 4,576,762 | 3/1986 | Griffin et al. | 123/198 D X |
| 4,690,115 | 9/1987 | Conlogue et al. | 123/198 DB X |
| 4,712,443 | 12/1987 | Deane | 74/513 X |
| 4,779,480 | 10/1988 | Stocker | 261/65 X |

FOREIGN PATENT DOCUMENTS

| | | | |
|---|---|---|---|
| 2908179 | 9/1979 | Fed. Rep. of Germany | 123/198 DB |
| 1534491 | 12/1978 | United Kingdom | 261/65 |

*Primary Examiner*—Vinh T. Luong

*Attorney, Agent, or Firm*—Armstrong, Nikaido, Marmelstein, Kubovcik & Murray

[57] ABSTRACT

A throttle control system including a throttle valve shaft and a throttle valve mounted at a middle portion with the shaft being rotatably carried on a support and spring-biased in a direction to close the throttle valve, and an operating lever and a control lever connected to said shaft. A first lever is fixed to the throttle shaft, and a lost motion lever is carried on said shaft and is capable of engaging the first lever. The operating lever is capable of engaging the lost motion lever. The relative positions of the first and the lost motion levers are established so that they are engaged with each other when the lost motion lever is rotated in the throttle valve-closing direction and the relative positions of the lost motion lever and the operating lever are established so that they are engaged with each other when the operating lever is rotated in a throttle valve-opening direction. A second lever is fixed to the throttle shaft with the control lever being rotatable relative to the second lever so that the second lever can be relatively rotated within an extent or rotation of the throttle valve when the control lever is stationary.

1 Claim, 3 Drawing Sheets

THROTTLE CONTROL SYSTEM

BACKGROUND OF THE INVENTION

The present invention relates to a throttle control system comprising an operating lever operable in response to an operation of an accelerator pedal, and a control level operatively connected to an actuator, the levers being connected to a throttle shaft which includes a throttle valve and which is rotatably carried on a support and spring-biased in a direction to close the throttle valve.

DESCRIPTION OF THE PRIOR ART

Such system is conventionally known, for example, from Japanese Patent Application Laid-Open Publication No. 186022/87.

In the above prior art system, however, an actuator and various levers are disposed in association with one another on one end side of the throttle shaft to constitute the throttle control system. Therefore, an increase in the entire size of the system cannot be avoided, and the balance of the interlocking system is inferior. In addition, there is also a disadvantage that if the control lever is controlled to rotate in the throttle valve-opening direction by the actuator, the operating lever is also rotated in the throttle valve-opening direction resulting in a looseness produced in a throttle cable connected to the operating lever.

The present invention has been accomplished with such circumstances in view, and it is an object of the present invention to provide a throttle control system wherein a reduction in size is provided, and the control by the actuator does not influence the operating lever.

SUMMARY OF THE INVENTION

The present invention provides a throttle control system comprising an operating lever operable in response to an operation of an accelerator pedal, and a control lever operatively connected to an actuator, the levers being connected to a throttle shaft which includes a throttle valve and which is rotatably carried on a support and spring-biased in a direction to close the throttle valve, wherein on one side of the support along an axis of the throttle shaft, there are disposed a first lever fixed to the throttle shaft, and a lost motion lever capable of engaging the first lever and the operating lever capable of engaging the lost motion lever, which are disposed for rotation relative to the first lever, the relative positions of the first and the lost motion lever being established so that they are engaged with each other when the lost motion lever is rotated in the throttle valve-closing direction, the relative positions of the lost motion lever and the operating lever being established so that they are engaged with each other when the operating lever is rotated in a throttle valve-opening direction; and on the other side of the support along the axis of the throttle shaft, there are disposed a second lever fixed to the throttle shaft, and the control lever rotatable relative to the second lever, the second lever and the control lever being engaged with each other so that the second lever can be relatively rotated within an extent of rotation of the throttle valve when the control lever is stationary.

With the above construction, when an operating force provided by the operating lever acts in the throttle valve-opening direction, the operating lever engages the lost motion lever, and the rotation of the lost motion lever is transmitted to the first lever through the lost motion spring, thereby opening the throttle valve. When the control lever is rotated in the throttle valve-closing direction by the actuator in a non-operated condition of the accelerator pedal, a driving force in the throttle valve-opening direction is transmitted from the control lever via the second lever to the throttle shaft. At this time, the first lever is also rotated in the throttle valve-opening direction and further, the lost motion lever is also rotated in the throttle valve-opening direction, but the engagement of the lost motion lever with the operating lever is released so that any influence cannot be exerted on the operating lever. Further, when the control lever is driven in the throttle valve-closing direction by the actuator in a condition of the throttle valve being operated to a certain opening degree by the operating lever, the second lever and thus the throttle shaft are rotated by the control lever, whereby the throttle valve is closed. At this time, the operation of the first lever is absorbed by the lost motion spring and hence, there is not produced any mutual interference between the control lever and the operating lever. Moreover, a reduction in size is possible because the individual components constituting the throttle control system are disposed in a distributed manner on the opposite sides of the support along the axis of the throttle shaft.

BRIEF DESCRIPTION OF THE DRAWINGS

The drawings illustrate one embodiment of the present invention wherein.

DETAILED DESCRIPTION OF A PREFERRED EMBODIMENT

Figure 1:
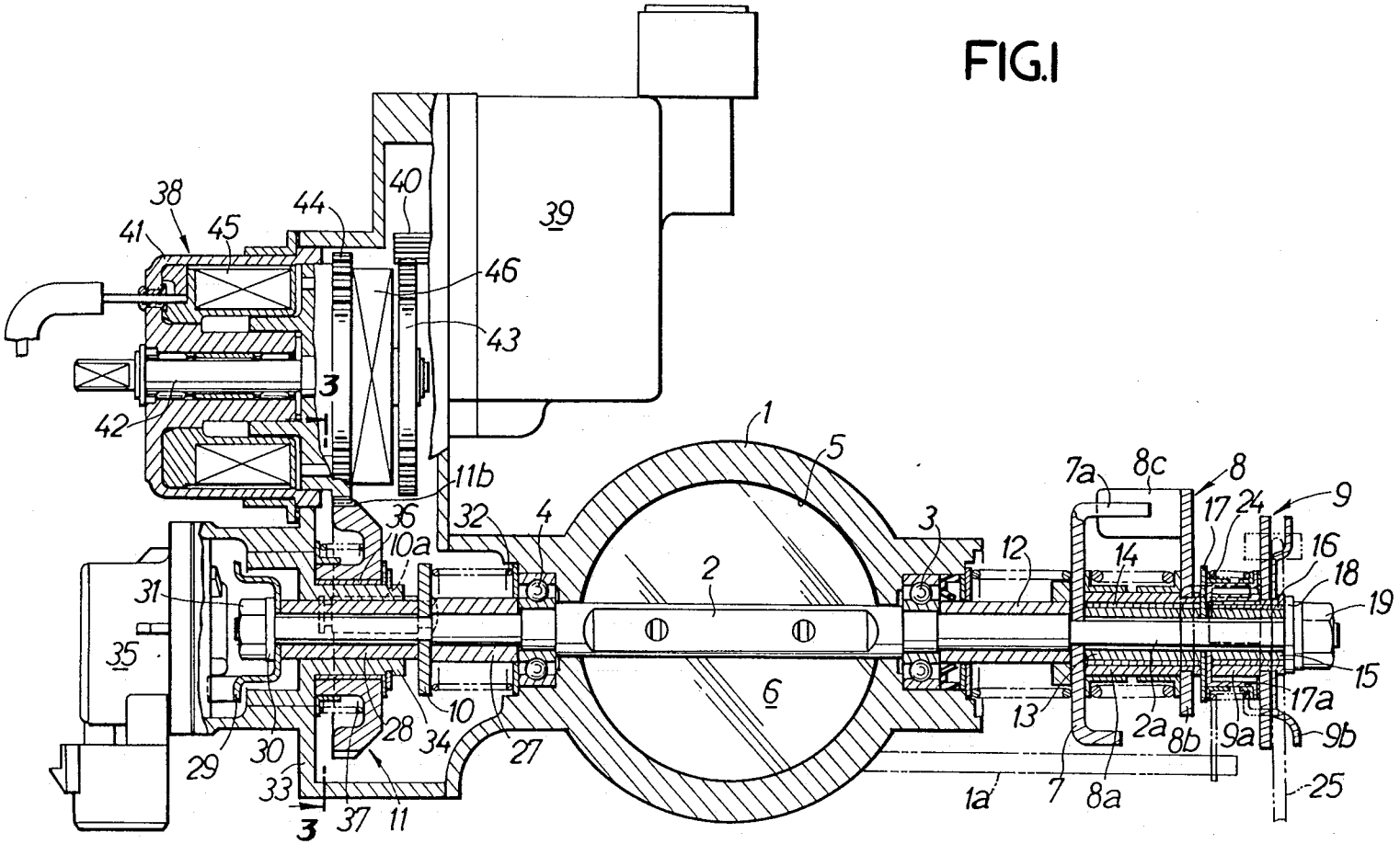
FIG. 1 is a cross-sectional view of one embodiment of the present invention taken at arrows 3—3 of FIG. 1.
Figure 2:
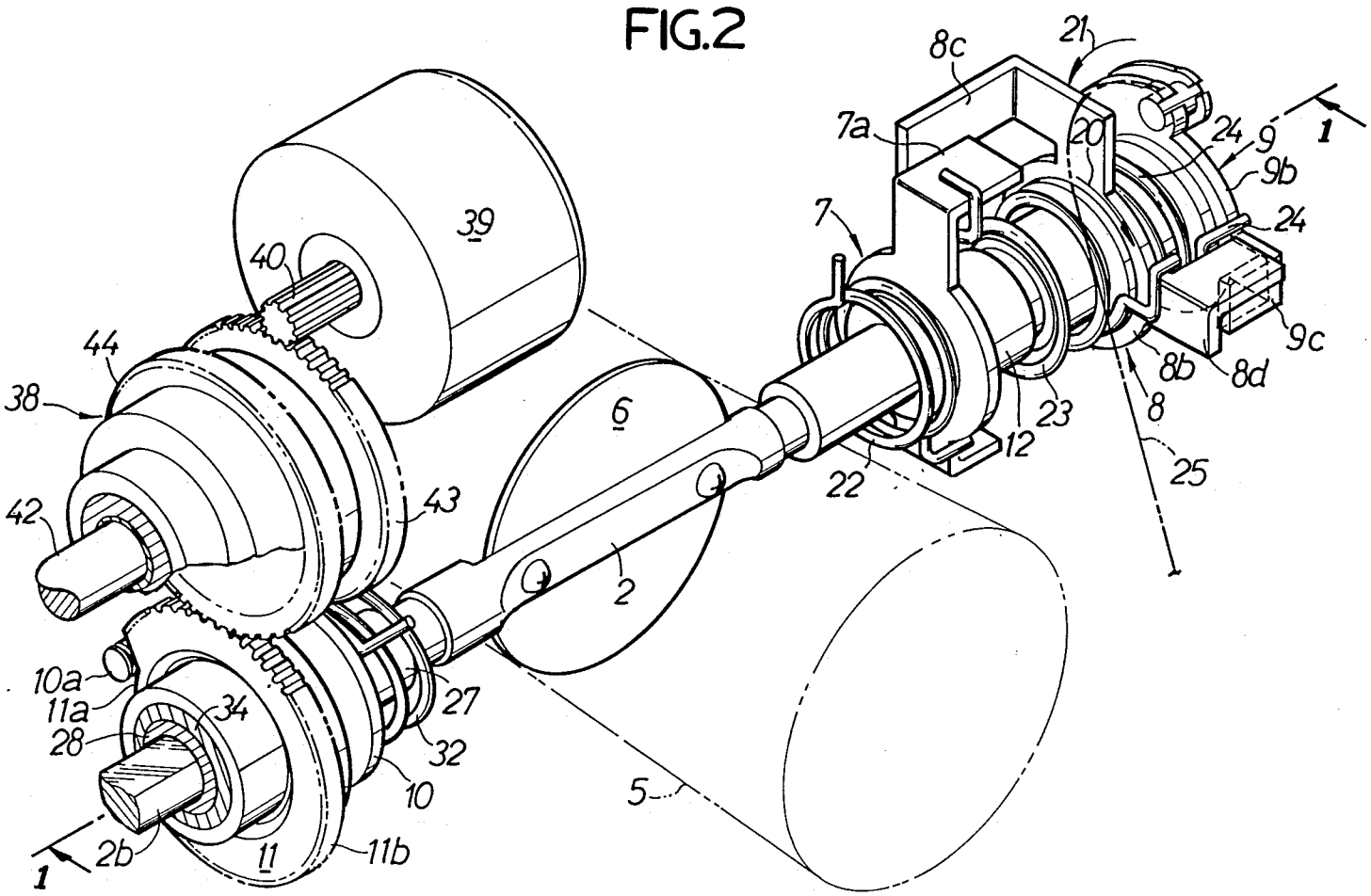
FIG. 2 is a perspective view of the same.

The present invention will now be described by way of one embodiment with reference to the accompanying drawings. Referring first to FIGS. 1 and 2, a throttle shaft 2 is rotatably supported on a throttle body 1 as a support through bearings 3 and 4. A butterfly type throttle valve 6 is fixedly mounted on the throttle shaft 2 for opening and closing an intake passage 5 provided in the throttle body 1.

Opposite ends of the throttle shaft 2 project from the throttle body 1 to opposite sides thereof, respectively. On one end side (a right in FIG. 1) of the throttle shaft 2 projecting from the throttle body 1, a first lever 7 is fixedly mounted, and a lost motion lever 8 and an operating lever 9 are supported for relative rotation about the same axis as the first lever 7. On the other end (a left side in FIG. 1) of the throttle shaft 2 projecting from the throttle body 1, a second lever 10 is fixedly mounted, and a control lever 11 is supported for relative rotation about the same axis.

A rectangular portion **2*a* of a generally rectangular cross-section extending from a middle portion on the one end side of the throttle shaft projecting from the throttle body 1 to a leading end thereof is provided by cutting out an outer periphery of the throttle shaft 2 to form a pair of flat surfaces along one diametrical line. A cylindrical collar 12 is fitted over a base portion on the one end side of the throttle shaft 2 with its inner end abutting against the bearing 3. The first lever 7 is fitted over the rectangular portion 2*a* in such a manner that it may be received by an outer end of the collar 12. Specifically, the first lever 7 is basically formed into a disk which is provided at its central portion with a hole having a shape corresponding to the rectangular portion 2a. A first engagement arm 7a is integrally provided on the first lever 7**.

A cylindrical collar 13 is fitted over the rectangular portion 2a, so that its inner end may be received by the first lever 7, and the lost motion lever 8 is also mounted on the rectangular portion 2a with a cylindrical bearing 14 interposed between the collar 13. Specifically, the lost motion lever 8 is comprised of a cylindrical portion 8a, a disk-shaped portion 8b fixedly mounted on an outer end of the cylindrical portion 8a, a second engagement arm 8c provided on the disk-shaped portion 8b to engage the first engagement arm 7a of the first lever 7, and a third engagement arm 8d provided on the cylindrical portion 8a at a place circumferentially offset from the second engagement arm 8c. The bearing 14 is interposed between the cylindrical portion 8a and the collar 13 Moreover, the axial lengths of the cylindrical portion 8a, the collar 13 and the bearing 14 are set at the same value.

Further, a cylindrical collar 15 is fitted over the rectangular portion 2a. The operating lever 9 is mounted on the rectangular portion 2a with a cylindrical bearing 16 interposed between the collar 15. The operating lever 9 is comprised of a cylindrical portion 9a with a bearing 16 interposed between the collar 15, a drum portion 9b fixedly mounted on an outer end of the cylindrical portion 9a, and a fourth engagement arm 9c provided on the drum portion 9b to engage the third engagement arm 8d of the lost motion lever 8. A restricting plate 17 is clamped between inner ends of the cylindrical portion 9a, the collar 15 and the bearing 16 and outer ends of the cylindrical portion 8a of the lost motion lever 8, the collar 13 and the bearing 14.

A nut 19 is threadedly engaged on a leading end of the throttle shaft 2 projecting from the cylindrical portion 9a of the operating lever 9, the collar 15 and the bearing 15, with a washer 18 interposed between the nut 19 and outer ends of the cylindrical portion 9a, the collar 15 and the bearing 16. This ensures that the first lever 7 is fixed to the throttle shaft 2, and that the lost motion lever 8 and the operating lever 9 are carried on the throttle shaft 2 for relative rotation about the same axis as the axis of the throttle shaft 2.

The circumferential relative positions of the first lever 7 and the lost motion lever 8 are established so that the first engagement arm 7a and second engagement arm 8c engage each other when the lost motion lever 8 is rotated in a throttle valve-closing direction shown by an arrow 20. The circumferential relative positions of the lost motion lever 8 and the operating lever 9 are established so that the third engagement arm 8d and fourth engagement arm 9c engage each other when the operating lever 9 is rotated in a throttle valve-opening direction 21. Moreover, a first return spring 22 is interposed between the first lever 7 and the throttle body 1 for biasing the first lever 7 and the throttle shaft 2 in the throttle valve-closing direction. A lost motion spring 23 is interposed between the first lever 7 and the lost motion lever 8 for exhibiting a spring force in a direction to bring the first and second engagement arms 7a and 8c into engagement with each other. In addition, an operating lever spring 24 is interposed between the throttle body 1 and the operating lever 9 for biasing the operating lever 9 in the throttle valve-closing direction 20, and one end of the spring 24 is engaged, for example, with a pin 1a embedded in the throttle body 1.

A throttle cable 25 operable for drawing in response to an operation of an accelerator pedal is connected to the drum portion 9b of the operating lever 9 so as to drive the operating lever 9 for rotation in the throttle valve-opening direction 21 during a drawing operation thereof.

Figure 3:
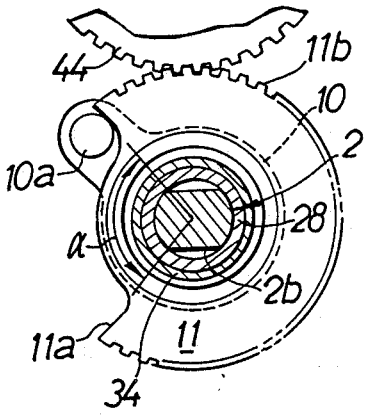
FIG. 3 is an end, partial cross-sectional view.

Referring also to FIG. 3, a rectangular portion 2b of a generally rectangular cross-section extending from a middle portion on the other end side of the throttle shaft projecting from the throttle body 1 to the leading end thereof is provided by cutting out the outer periphery of the throttle shaft 2 to form a pair of flat surfaces along one diametrical line. A cylindrical collar 27 is fitted over the base portion on the other end side of the throttle shaft 2 with its inner end abutting against the bearing 4. The second lever 10 is fitted over the rectangular portion 2b in such a manner that it may be received by an outer end of the collar 27. Specifically, the lever 10 is basically formed into a disk which is provided at its central portion with a hole having a shape corresponding to the rectangular portion 2b. An engagement pin 10a is embedded in the second lever 10 at a place offset from an axis of the second lever 10.

A cylindrical collar 28 is fitted over the rectangular portion 2b with its inner end received by the second lever 10. A nut 31 is threadedly engaged over the leading end of the throttle shaft 2 with a detecting member 29 and washer 30 interposed between the nut and an outer end of the collar 28. This ensures that the second lever 10 is fixed to the throttle shaft 2. A second return spring 31 is interposed between the second lever 10 and the throttle body 1 for biasing the second lever 10 and thus the throttle shaft 2 in the throttle valve-closing direction 20.

A cover 33 is mounted on the throttle body 1 to enclose the other end of the throttle shaft 2 projecting from the throttle body 1, and a basically cylindrical holder 34 is press-fitted into and fixed to the cover 33 concentrically with the throttle shaft 2. Further, a rotation angle detector 35 is fixed to the cover in an opposed relation to the leading end of the throttle shaft 2. The detecting member 29 is engaged with the rotation angle detector 35. The rotation angle of the throttle shaft 2, i.e., the opening degree of the throttle valve 6 is detected by the rotation angle detector 35.

The control lever 11 is rotatably carried on the holder 34 through a bearing 36 and provided on its outer periphery with an engagement recess 11a engaging with the engagement pin 10a, and a gear portion 11b which is a remaining portion excluding the engagement recess 11a (see FIG. 3). The gear portion 11b is formed to have a center angle corresponding to an extent of rotation of the throttle valve 6. A control lever spring 37 is interposed between the control lever 11 and the cover 33 for biasing the control lever 11 in the throttle valve-opening direction 21. Thus, the control lever 11 is biased for rotation by the control lever spring 37 so that the engagement pin 10a comes into contact with a rear end of the engagement recess 11a in the throttle valve-opening direction 21. With such a construction, when an operational force provided by the operating lever 9 acts on the throttle shaft 2 with the control lever 11 having been in a stationary state for any reason, the engagement pin 10a can be rotated within the engagement recess 11a, and a rotative force of the control lever 11 is immediately transmitted to the second lever 10.

The control lever is connected to a step motor 39 as an actuator through an electro-magnetic clutch 38. More specifically, the step motor 39 is fixed to the cover 33 and has an axis parallel to the throttle shaft 2. The electro-magnetic clutch 38 is interposed between a drive gear 40 provided on an output shaft of the step motor 39 and the gear portion 11*b* of the control lever 11.

The electro-magnetic clutch 38 comprises a casing 41 fixed to the cover 33, a rotary shaft 42 rotatably carried on the casing 41, an input gear 43 fixedly mounted on the rotary shaft 42 to mesh with the drive gear 40, an output gear 44 relatively rotatably carried on the rotary shaft 42 to mesh with the gear portion 11*b* of the control lever 11, a solenoid 45 fixedly disposed within the casing 41 to surround the rotary shaft 42, and an actuating portion 46 disposed between the input and output gears 43 and 44 to interconnect the rotary shaft 42 and the output gear 43 upon excitation of the solenoid 45.

The operation of this embodiment will be described below. When the operating lever 9 is driven for rotation in the throttle valve-opening direction 21 by an operation of accelerator pedal in a condition where the electro-magnetic clutch 38 has been first disengaged and the step motor 39 has been stopped, the engagement of the fourth and third engagement arms 9*c* and 8*d* allows the lost motion lever 8 to be rotated in the throttle valve-opening direction 21. Then, the rotation of the lost motion lever 8 is transmitted to the first lever 7 through the lost motion spring 23, so that the first lever 7 and thus the throttle shaft 2 are rotated until the first engagement arm 7*a* engages the second engagement arm 8*c*. This causes the throttle valve 6 to be rotated in a desired degree of opening.

During such a rotation of the throttle valve 6, the second lever 10 is also rotated together with the throttle shaft 2, and because the electro-magnetic clutch 38 is disengaged, the control lever 11 is freely rotatable and also rotated in the throttle valve-opening direction 21 as the second lever 10 is rotated in the throttle valve-opening direction 21.

Then, to rotatively drive the throttle valve 6 in the throttle valve-opening direction 21, to a certain degree of opening by the step motor 39 without an operation of the accelerator pedal, the electro-magnetic clutch 38 is brought into engagement and the step motor 39 is rotated in a normal direction. This rotation of the step motor 39 is transmitted from the drive gear 40 via the input gear 43, the actuating portion 46 and the output gear 44 to the control lever 11, so that the control lever 11 is rotated in the throttle valve-opening direction 21. During this time, the rotation of the control lever 11 causes the second lever 10 to be rotated in the throttle valve-opening direction 21, thereby opening the throttle valve 6, because the engagement pin 10*a* is in engagement with the recess 11*a*.

In such a valve-opening operation, the first lever 7 is also rotated in the throttle valve-opening direction 21, and the engagement of the first and second engagement arms 7*a* and 8*c* permits the lost motion lever 8 to be also rotated in the throttle valve-opening direction 21. However, the third and fourth engagement arms 8*d* and 9*c* are moved away from each other for disengagement and hence, any influence cannot be exerted on the operating lever 7. Therefore, the throttle cable 25 cannot be flexed.

To control the throttle valve 6 to its closed position in a condition of the throttle valve 6 rotated to a certain degree of opening by the operating lever 9, the electro-magnetic clutch 38 is brought into engagement and the step motor 39 is reversed. If doing so, the control lever 11 is rotated in the throttle valve-closing direction 20, thereby driving the second lever 10 in the throttle valve-closing direction 20, thus closing the throttle valve 6.

When the throttle valve 6 has been controlled to its closed position in this manner, the rotating motion of the first lever 7 in the throttle valve-closing direction 20 is absorbed by the lost motion spring 23.

Now, it is considered that the step motor 39 or the electro-magnetic clutch 38 is not operated in respective of their control signals, that is, a malfunction occurs. Suppose that the control lever 11 has been then brought into a stationary state. In this case, the second lever 10 is relatively rotatable in the throttle valve-opening direction 21 to an extent corresponding to the extent of rotation of the throttle valve 6. Therefore, the throttle valve 6 can be closed by addition of an operating force from the operating lever 9.

Furthermore, since the first lever 7, the lost motion lever 8, the operating lever 9 and the like are disposed on one side of the throttle body 1, and the second lever 10, the control lever 11 and the like are disposed on the other side of the throttle body 1, the entire system is compact as compared with the disposition of the individual components only on the either side of the throttle body 1.

It is possible to control the opening and closing of the throttle valve 6 by the operation of the step motor 39 in the above manner independently of the operating force from the operating lever 9, but the control of the throttle valve 6 is applicable, for example, to a first idle control, an auto-cruise control and a traction control during speed-reduction, for operating the throttle valve 6 to its opened position by the operation of the control lever 11 in an accelerator non-operated condition, as well as a traction control at the start and during speed-increasing, for operating the throttle valve 6 to its closed position by the operation of the control lever 11 in an accelerator-operated condition.

In the above-described embodiment using the step motor 39 as an actuator, the electro-magnetic clutch 38 has been interposed between the step motor 39 and the control lever 11, but the electro-magnetic clutch is unnecessary when a motor of a type which is returned to the original position by a return spring is used.

As discussed above, according to the present invention, the throttle valve can be opened and closed through the first lever by actuating the operating lever. In addition, when the control lever has been driven by operating the actuator, engagement of the control lever with the second lever enables the throttle valve to be opened and closed. Any influence of the first lever on the operating lever during that time can be prevented. Further, since the first lever, the lost motion lever and the operating lever are disposed on one side of the support, and the second lever and the control lever are disposed on the other side of the support, the entire system can be constituted in a compact manner.

From the foregoing description of the preferred embodiment of the invention, it will be apparent that many modifications may be made therein. It should be understood that these embodiments are intended as one example of the invention only, and that the invention is not limited thereto. Therefore, it should be understood that the appended claims are intended to cover all modifications that fall within the true spirit and scope of the invention.

What is claimed is:

1. A throttle control system comprising a throttle valve shaft having opposite ends, a middle portion, and a throttle valve mounted at said middle portion, said shaft being rotatably carried on a support and spring-biased in a direction to close the throttle valve, an operating lever operable in response to an operation of an accelerator pedal, and a control lever operatively connected to an actuator, said levers being connected to said shaft; said system further comprising on one side of the support along an axis of the throttle shaft, a first lever fixed to the throttle shaft, and a lost motion lever carried on said shaft and being capable of engaging said first lever, the operating lever being capable of engaging said lost motion lever, both said lost motion and operating levers being disposed for rotation relative to the first lever, the relative positions of the first and the lost motion levers being established so that they are engaged with each other when the lost motion lever is rotated in the throttle valve-closing direction, the relative positions of the lost motion lever and the operating lever being established so that they are engaged with each other when the operating lever is rotated in a throttle valve-opening direction; and on the other side of the support along the axis of the throttle shaft, a second lever fixed to the throttle shaft, the control lever being rotatable relative to said second lever, said second lever and said control lever being engaged with each other so that the second lever can be relatively rotated within an extent of rotation of the throttle valve when said control lever is stationary.

* * * * *